US008524038B2

(12) United States Patent
Vilpponen et al.

(10) Patent No.: US 8,524,038 B2
(45) **Date of Patent: *Sep. 3, 2013**

(54) BLEACHING PROCESS OF CHEMICAL PULP

(75) Inventors: Aki Vilpponen, Varkaus (FI); Panu Tikka, Espoo (FI)

(73) Assignee: Oy Lannen Tutkimus—Western Research Inc., Espoo (FI)

( * ) Notice: Subject to any disclaimer, the term of this patent is extended or adjusted under 35 U.S.C. 154(b) by 531 days.

This patent is subject to a terminal disclaimer.

(21) Appl. No.: 12/295,378

(22) PCT Filed: Mar. 27, 2007

(86) PCT No.: PCT/FI2007/050168

§ 371 (c)(1),
(2), (4) Date: Nov. 10, 2008

(87) PCT Pub. No.: WO2007/113381

PCT Pub. Date: Oct. 11, 2007

(65) Prior Publication Data

US 2009/0242152 A1 Oct. 1, 2009

(30) Foreign Application Priority Data

Mar. 31, 2006 (FI) ..... 20060314

(51) Int. Cl.
*D21C 9/14* (2006.01)

(52) U.S. Cl.
USPC ..... 162/67; 162/60; 162/72

(58) Field of Classification Search
USPC ..... 162/60, 67, 72
See application file for complete search history.

(56) References Cited

U.S. PATENT DOCUMENTS

| | | | | |
|---|---|---|---|---|
| 3,884,752 | A | | 5/1975 | Campbell et al. |
| 5,352,332 | A | | 10/1994 | Maples et al. |
| 5,509,999 | A | * | 4/1996 | Lindberg ..... 162/29 |
| 5,510,035 | A | * | 4/1996 | Toronen et al. ..... 210/644 |
| 5,853,535 | A | | 12/1998 | Maples et al. |
| 6,048,437 | A | | 4/2000 | Fukushima et al. |

(Continued)

FOREIGN PATENT DOCUMENTS

| | | |
|---|---|---|
| FI | 954407 | 12/1996 |
| SE | 507164 | 4/1998 |

(Continued)

OTHER PUBLICATIONS

Gullichsen et al., Chemical Pulping 6A, 1999, Fapet Oy, p. A635-A665.*

(Continued)

*Primary Examiner* — Anthony Calandra
(74) *Attorney, Agent, or Firm* — Young & Thompson

(57) ABSTRACT

A process for the bleaching of chemical pulp, wherein the initial bleaching of the pulp includes a first chlorine dioxide treatment (D0) and a following alkaline treatment with oxygen and hydrogen peroxide (EOP), which stages are separated from each other with a washing stage, and a treatment of the pulp to reduce the content of transition metals of the pulp prior to the peroxide treatment. The process is characterized in that alkali is added to the pulp after addition of chlorine dioxide in the D0 stage to adjust the pH of the pulp to neutral or basic (N stage) prior to the washing stage following the chlorine dioxide stage, whereby the initial bleaching includes the sequence D0N EOP.

9 Claims, 4 Drawing Sheets

(56) References Cited

U.S. PATENT DOCUMENTS

| | | | | |
|---|---|---|---|---|
| 6,258,208 | B1 * | 7/2001 | Lindeberg et al. | 162/65 |
| 6,569,284 | B1 * | 5/2003 | Yin et al. | 162/29 |
| 6,776,876 | B1 * | 8/2004 | Vuorinen et al. | 162/65 |
| 6,831,388 | B1 | 12/2004 | Leijon et al. | |
| 2004/0112555 | A1 | 6/2004 | Tolan et al. | |
| 2005/0150619 | A1 | 7/2005 | Tolan et al. | |
| 2006/0201642 | A1 | 9/2006 | Shin et al. | |

FOREIGN PATENT DOCUMENTS

| | | | |
|---|---|---|---|
| WO | 93/15264 | | 8/1993 |
| WO | WO 9715713 | | 5/1997 |
| WO | 9925919 | A1 | 5/1999 |
| WO | 03083208 | A1 | 9/2003 |

OTHER PUBLICATIONS

Bucher et al., A Survey of Mills Using Caustic Extraction Stage Chemistry, Aug. 2005, 2005 Engineering, Pulping & Environmental Conference, whole document.*

International Search Report dated Jun. 28, 2007, in PCT application.

Ljunggren et al., "Chlorine Dioxide bleaching with a two-step low-to-high pH profile," Tappi J., vol. 79, No. 12, pp. 152-160 (1996).

Supplementary European Search Report, dated Feb. 28, 2012, from corresponding EP application.

* cited by examiner

BLEACHING PROCESS OF CHEMICAL PULP

BACKGROUND OF THE INVENTION

1. Field of the Invention

This invention relates to the bleaching of chemical pulp. More particularly, the invention relates to initial bleaching of sulphate pulp, bleaching sequences and filtrate cycles related thereto. The initial bleaching sequence according to the invention comprises treating the pulp in order to reduce the content of transition metals present in the pulp, a first chlorine dioxide treatment (D0) of the bleaching, addition of alkali in the D0 stage after addition of chlorine dioxide to adjust the pH value to be neutral or basic, followed by washing, and an alkaline oxygen and peroxide stage (EOP) as a stage carried out subsequent to the washing.

2. Description of the Related Art

The bleaching of sulphate pulp is divided into initial and final bleaching. During the initial bleaching, most of the lignin present in the pulp is removed. In the final bleaching, the residual lignin still present in the pulp is removed, and pulp darkening coloured groups, chromophores, are converted into the non-light-absorbing form.

The initial bleaching of sulphate pulp using chlorine dioxide conventionally consists of an acid delignification stage, generally a chlorine dioxide stage D0, and an alkaline extraction stage E, which is often reinforced with oxygen and peroxide (EOP) or with one of these (EO or EP). In addition to delignification, the acid stage releases metals present in the pulp. Furthermore, hexenuronic acid groups consuming bleaching chemicals may be removed by a hot acid treatment of the pulp.

The D0 stage and E stage of the initial bleaching are separated from each other by intermediate washing. In the washing, dissolved organic matter, spent chemicals and metals being free in ionic form in acid conditions, are removed from the pulp.

A dosage of active chlorine in the D0 stage is often relatively high, usually more than half of the chlorine dosage of the whole bleaching stage. The reactions of chlorine dioxide in the D0 stage are rapid, consuming thus a main part of the charged chemicals in a few seconds. However, the retention time in the D0 stage is usually about 30 minutes to ensure the reaction of all chemicals and to achieve a kappa number after the D0 EOP stages being as low as possible.

The reactions of chlorine dioxide degrade the structures of lignin. The filtrates resulting from the D0 stage contain a part of the reacted lignin and the main part of the spent chlorides. A substantial part of the lignin reacted during the D0 stage will be converted into a dissolving form only in a following alkaline stage so that the filtrate resulting from the EOP stage contains a remarkable amount of dissolved organic matter as well as chlorine bound to the lignin during the D0 stage.

The transition metals, such as Fe, Cu and Mn, degrade peroxide, and should thus substantially be removed from the pulp, or their content should be reduced prior to a stage using peroxide, i.e. prior to the EOP stage. Most of the metals can be removed in the washing stage, when the pH is sufficiently low, approximately pH 3. Hence, in the washing stage following a first acid stage of the bleaching, metals being precipitated in alkaline conditions are removed from the pulp. At a higher pH, an effective removal of the metals requires the use of a chelating agent. Said first acid stage of the bleaching may also be a separate acid treatment (A) of the pulp prior to a first acid oxidative stage (D0). If the acid stage is carried out at a higher temperature than normal, at about 90° C., also hexenuronic acids may simultaneously be degraded and thus removed. The degradation of the hexenuronic acids also releases other metals which can be removed by washing.

The effluents resulting from the bleaching form a significant part of the effluents from a the whole pulp mill. The washing filtrates are circulated within a bleaching plant from stage to stage, if possible. There has been efforts to reduce the amount of effluents also by using the resulting filtrates for other processes of the mill, i.a. for washing of brown stock. Thereby the filtrates and the dissolved wood material and chemicals present in the filtrate are fed to a recovery process of chemicals. The filtrates resulting from the D0 stage contain a large amount of chlorides which are detrimental to a recovery process.

Therefore, there has been efforts to recover filtrates resulting from the alkaline stage carried out subsequent to the D0 stage. However, also these filtrates contain chlorine compounds, because a substantial part of the lignin reacted during the D0 stage dissolves only during the alkaline treatment. Hence, in an effort to reduce the consumption of alkali, the filtrate resulting from the E stage has been used as a washing and dilution fluid in a D0 stage washer. However, bleaching chemicals are consumed by the great amount of dissolved matter present in the filtrate resulting from the EOP stage. Hence, the filtrates resulting from the alkaline and acid stages of the initial bleaching are usually removed to effluent treatment.

In existing facilities, the EOP stage of the initial bleaching is carried out as a separate step, whereby there is an intermediate washing step between the D0 and EOP stages. Alkalizing subsequent to a chlorine stage has been searched in a case wherein the next stage is a first acid D stage of the final bleaching, but the chemical consumption has been remarkably high compared to an alkali stage separated by intermediate washing /1/. Cook /2/, has suggested a combination of the D stage and the oxidative alkaline stage of the initial bleaching without an intermediate washing step. Ljungren /3/ has found that alkalizing combined to a chlorine dioxide stage reduces AOX discharges. In these three researches, the combination of the chlorine dioxide and the alkali stages is used to substitute an initial bleaching comprising separate chlorine or chlorine dioxide and alkali stages, whereby the next stage is a first acid D stage of the final bleaching, as is the case also in displacement bleaching.

In general, chlorine dioxide and peroxide are used for the final bleaching. In the final bleaching based on chlorine dioxide, the sequences D, DD and DnD are employed, either with or without intermediate washing steps between the stages. In the DnD sequence, the intermediate washing is carried out after the Dn treatment, but the neutralization after the D stage may be accomplished also without washing /4/. Suess et al. /5/ has researched the performance of the D and P stages of the final bleaching without intermediate washing between the stages. In a process of U.S. Pat. No. 3,884,752, neutralization carried out subsequent to the D1 stage is substituted for a previously generally used separate alkaline E2 stage. According to U.S. Pat. No. 4,238,281, the whole final bleaching is carried out without intermediate washing steps, DED.

In the displacement bleaching (pulse, dynamic bleaching) /6, 7, 8, 9/, the filtrate present in the pulp is displaced at the end of the stage by a filtrate resulting from next stage. The displacement bleaching is carried out using diffuser washers /10/. Therein the acid filtrate present in the pulp is displaced by the chemicals of next stage, and the reacted, but in acid conditions undissolved matter remains in the pulp, and the main part of dissolving matter remains in the pulp and is passed to next bleaching stage.

SUMMARY OF THE INVENTION

An object of the present invention is to reduce the demand for bleaching chemicals, to which alkali is herein not considered to belong, in the bleaching of chemical pulp and to reinforce the effectiveness of an alkali stage subsequent to the D0 stage carried out using oxygen and peroxide (EOP). Further, the purpose of the invention is to improve the use of washing filtrates, especially the washing filtrates resulting from the EOP stage of the initial bleaching in a bleaching mill and/or for washing of brown stock.

In a process according to the invention, the initial bleaching of pulp comprises a first chlorine dioxide treatment (D0) and a following alkaline treatment with oxygen and hydrogen peroxide (EOP) which stages are separated from each other with a washing stage. Prior to the peroxide treatment, the pulp is treated in order to reduce the content of transition metals present in the pulp. The process according to the invention is characterized in that alkali is added to the pulp after addition of chlorine dioxide in the D0 stage in order to adjust the pH of the pulp to be neutral or basic (N stage) prior to the washing stage subsequent to the chlorine dioxide stage whereby the initial bleaching comprises the sequence D0N EOP.

In proceeding according to the invention, the dissolution of organic matter increases during the first chlorine dioxide treatment of the bleaching, whereby also a higher amount of chlorides is removed from the pulp during the washing step subsequent to said stage (D0N). Hence, the amount of chlorides decreases especially in the following EOP stage, enlarging thus the possibilities of the use of the filtrates resulting from the EOP stage, also for washing of brown stock. Likewise, the use of oxidizing chemicals becomes more effective because the peroxide of the EOP stage is consumed by the lignin still present in the pulp and not for further treatment of lignin degraded already during the first chlorine dioxide treatment which lignin in the process according to the invention is removed by neutralizing or alkalizing already prior to the washing step. The dosage of chlorine dioxide can be reduced, if desired, because the EOP stage operates more effectively.

In a process according to the invention, the treatment for removing transition metals may be e.g. an acid treatment (A) of the pulp followed by washing prior to the D0N stage.

The filtrate resulting from the pulp after the first chlorine dioxide treatment (D0) of the initial bleaching according to the prior art is acid. In the process according to the present invention, the filtrate resulting after the chlorine dioxide treatment is neutral or basic, enabling thus the rearrangement of the filtrate cycles in the bleaching. A smaller amount of dissolved matter and chlorides facilitate the control of the filtrates resulting especially from the EOP stage into a recovery, for example, via brown stock washing in order to reduce effluents resulting from the bleaching.

BRIEF DESCRIPTION OF THE DRAWING FIGURES

The accompanying FIGS. 1 to 3 show a few preferred bleaching sequences of an initial section thereof, as well as filtrate and washing water cycles using an initial bleaching sequence according to the invention.

DETAILED DESCRIPTION OF THE INVENTION

Figure 1A:
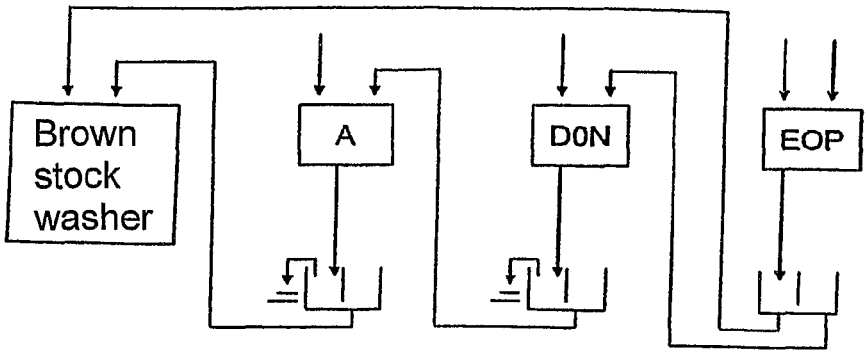
FIGS. 1A to 1E show a few washing water cycles of a sequence A D0N EOP according to the invention.
Figure 1B:
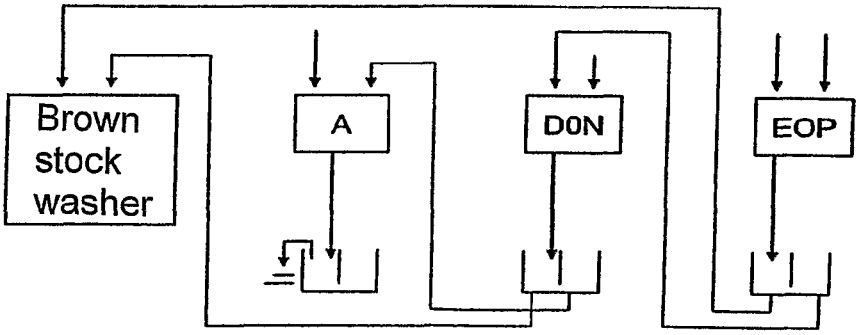
Figure 1C:
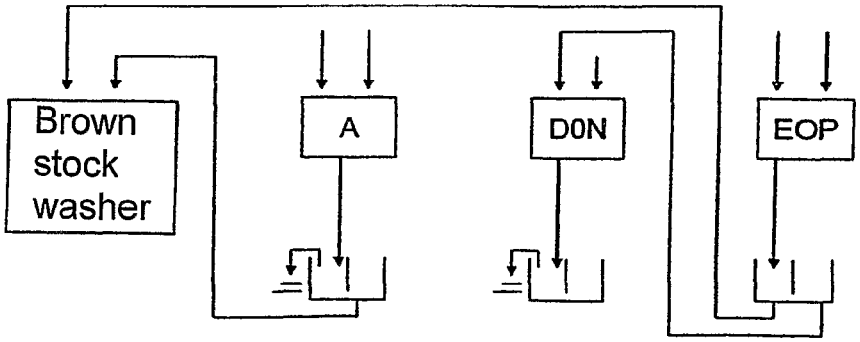

The treatment for removing transition metals belonging to the initial bleaching according to the invention, may be, for instance, a separate acid treatment (A) and washing of the pulp prior to the D0N stage. Said treatment to reduce the content of transition metals may also be e.g. a separate chelating step prior to the D0N stage. Said treatment could also be a separate treatment subsequent to the D0N stage, whereby the initial bleaching sequence would be D0N Q EOP. Acidification (A) of pulp entering the bleaching as a step carried out just before the D0N stage is especially advantageous, since adjustment of the pH value up and down will then be avoided. When the temperature is sufficiently high, e.g. from 80 to 95° C., during the acid treatment stage (A), also hexenouronic acids consuming bleaching chemicals can simultaneously be removed, which is advantageous particularly when hard wood pulp is used.

The first chlorine dioxide treatment of the initial bleaching according to the invention may be carried out under the conditions of a conventional DO stage. In the process according to the invention, the retention time in the chlorine dioxide treatment is from 10 sec to 120 min, preferably from 1 to 30 min, most preferably from 1 to 15 min, the active chlorine dosage (kg/adtp) is about 2 to 2.5 times the kappa number or from 10 to 60 kg as active chlorine per ton of air dry pulp (hereafter expressed as kg act. Cl/adtp), preferably from 20 to 50 kg act. Cl/adtp, most preferably from 15 to 40 kg act. Cl/Iadtp, the final pH is from 1 to 5, preferably from 2 to 3.5, and the thickness is from 1 to 40%, preferably from 3 to 15%. The temperature is preferably between 50 and 95° C., usually between 50 and 65° C. The addition of alkali after the addition of chlorine dioxide in order to adjust the pH value to be neutral or basic lowers the kappa number of the pulp and improves the effectiveness of the following bleaching stages, reducing thus the consumption of the chemicals in the bleaching. In the first chlorine dioxide stage of the bleaching, the dosage of the chemicals may be reduced, if desired. When the required chemical dosage is smaller, the charged chlorine dioxide is consumed very rapidly and the required retention time in the chlorine dioxide treatment is decreased. The decreased need of chlorine dioxide results in a decrease in the consumption of alkali in the alkalizing step following the D0 treatment. In the D treatment of the D0N stage, the pulp may, in addition to chlorine dioxide, be treated also with ozone, peracetic acid or Caro's acid or a combination thereof.

The alkali treatment to be carried out at the end of the chlorine dioxide stage lowers the kappa number after the initial bleaching, enabling thus the use of a smaller dosage of chlorine dioxide to obtain a particular kappa number. Due to this, the retention time in the chlorine dioxide treatment may be shorter than usually. The retention time in the chlorine dioxide treatment may further be shortened, if a hot acid treatment ($A_{hot}$) carried out prior to the the chlorine dioxide treatment is used as a treatment to remove transition metals, because in that case chlorine dioxide is not consumed by hexenuronic acids, thus enabling a reduction of the chlorine dioxide dosage. In said hot acid treatment, the temperature is about 80 to 95° C.

The D0N treatment can be accomplished in a conventional thickness of the process, and the alkali treatment of the D0N stage may be carried out e.g. in the inlet of a washer, in a connection pipe or in a separate reactor. As alkali, sodium hydroxide and oxidized or unoxidized white liquor may be used. The retention time in the alkali treatment may be from a few seconds to several hours, preferably from 5 sec to 60 min, preferably from 40 sec to 15 min. A suitable alkali dosage is preferably from 1 to 20 kg alkali as NaOH/ton of air dry pulp (kg as NaOH/adtp), preferably from 1 to 15 kg as NaOH/adtp. The effective time is from 5 sec to 60 min, preferably from 40 sec to 15 min, the temperature is from 50° C. to 100° C., preferably from 60 to 95° C. and the thickness is in conformity to the preceding treatment. The treatment is intensified with the increase of the retention time and the temperature, whereby also the consumption of alkali will increase.

Alkali for the N treatment belonging to the initial bleaching according to the invention is added after the reactive stage of chlorine dioxide. A suitable pH in the chlorine dioxide treatment after the addition of alkali is from 6 to 12, preferably from 7 to 12, more preferably from 8 to 11. In one embodiment, said pH is preferably above 10, but at most 12. In another embodiment, pH is between 7 and below 10. In the DON stage, the decrease of the kappa number increases with the increase of the pH, but hereby also the alkali consumption increases correspondingly. On the other hand, alkali, especially white liquor, is more economic compared e.g. to peroxide and chlorine dioxide.

In the EOP stage following the D0N stage after washing, the temperature is preferably from about 75 to 90° C., but the alkali dosage may be smaller than usually, e.g. from 5 to 15 kg/adtp, more preferably from 3 to 12 kg/adtp, compared to the EOP stage of a traditional initial bleaching. In the EOP stage of the initial bleaching, also the dosage of peroxide may be reduced, if desired, because peroxide is consumed only in the reactions of the lignin still present in the pulp. In the process according to the invention, the dosage of hydrogen peroxide may be e.g. from 2 to 10 kg/adtp, preferably from 2 to 5 kg/adtp.

With the process according to the invention, a filtrate is obtained from the DON stage containing a greater part of the chlorides than earlier and a substantial part of dissolved organic matter. The pH of the filtrate is from 6 to 12, preferably from 7 to 12, more preferably from 8 to 11. The filtrate to be discharged from the washer of the following alkaline stage (EOP) contains smaller amounts of chlorides and dissolved organic matter than the filtrate resulting from the E0P stage subsequent to a conventional D0 stage.

When using white liquor or oxidized white liquor for alkalizing in the D0N stage, the Na/S balance of the chemical cycle may be adjusted in a new way, and foreign matters present in the white liquor, such as Al, Cl, K and Si, may be removed. A decrease in the consumption of sodium hydroxide in the EOP stage reduces the influence on the Na-balance of a mill, if the filtrates are conducted to the recovery via brown stock washing.

Compounds causing precipitation, such as $CaC_2O_4$, $CaCO_3$, $BaSO_4$ as well as magnesium compounds will precipitate onto the fibres when the pH rises. In a D0N washer, the risk of precipitation remains unchanged or decreases, and the demand for magnesium addition in the EOP stage decreases. The precipitation of calcium carbonate may be controlled by limiting the rise of the pH in the N stage to a pH value of below 10.

The hot acid treatment (the A stage) to degrade hexenuronic acids can also be carried out in connection with the chlorine dioxide treatment of the D0N stage either as a hot pretreatment or so that the whole D0 stage is carried at a temperature sufficiently high to degrade hexenuronic acids, e.g at about from 90 to 95° C. However, in that case a separate step, e.g. a chelating step, is required to remove transition metals prior to the addition of peroxide in the EOP stage.

When using the initial bleaching according to the invention, the fiber pulp entering the initial bleaching is chemically produced, especially by a sulphate cook. The pulp enters the initial bleaching from a brown stock washer arranged after the cook or an oxygen stage. After the initial bleaching according to the invention and the subsequent washing of pulp, any bleaching sequence may be used to obtain a target value of the final brightness for the pulp.

Compared to the initial bleaching of the prior art, the initial bleaching sequence according to the invention enables to reduce the consumption of chlorine dioxide and peroxide as well as the use of shorter bleaching sequences. In one embodiment, the whole sequence of the bleaching consists of the initial bleaching sequence A D0N EOP according to the invention. In using the initial bleaching according to the invention, further preferred bleaching sequences are e.g. A D0N EOP D1, A D0N EOP P and A D0N EOP DP.

The filtrate resulting from a D0 stage of the prior art is acid. In the process according to the invention, the filtrate resulting from the D0N stage is neutral or basic, allowing thus the filtrate cycles in the bleaching to be arranged in a new way. A smaller amount of dissolved matter and chlorides facilitates conducting the filtrates resulting from the EOP stage to recovery, for instance, via brown stock washing, enabling thus the reduction of the effluents resulting from the bleaching.

Secondly, the circulation of the filtrates resulting from the bleaching, particularly from the initial bleaching, can be rearranged when pH changes in the D0 stage washer from acid (D0) to alkaline (D0N). Generally, mixing of an acid and an alkaline filtrate causes precipitation problems.

An unpressurized EOP stage can be carried out also without oxygen, so that in the present application the expression EOP refers also to an unpressurized EP stage.

In FIGS. 1 to 3 each box provided with a symbol representing the respective bleaching stage refers to a washer arranged after said stage. The arrows directed towards each of the washers refers to washing liquids entering the washer, whereby the left arrow indicates a first washing liquid and the right arrow indicates a following washing liquid. An arrow leaving a washer indicates a washing filtrate being discharged from the washer. A first liquid of the washing liquids used in the washers displaces the liquid present in the pulp at its entry into the washer which liquid is passed into a filtrate container, whereby the first washing liquid will remain in the pulp. This first washing liquid is displaced by a second washing liquid, whereby a greater part of the first washing liquid will also enter the filtrate container of the washer in question. All or part of the second washing liquid will remain in the pulp leaving the washer. When the washer is a press, the term first washing liquid refers to an actual washing liquid, whereby the term second washing liquid refers to a dilution after the washer. Also, when washers of another type, e.g. a filter or a DD washer, are used, a part of the second washing liquid may be used for the dilution after the washer.

In all shown figures, the filtrate to be discharged from the washer may be divided into different fractions with respect to its properties (e.g. with respect to the amount of dissolved matter) which are led to a filtrate container to be stored and used separately. In this case, the concentration of the filtrate (e.g. the amount of dissolved matter) discharged from the left side of the filtrate container, shown in the figures below the washer, is higher than that of the filtrate withdrawn from the right side of the filtrate container, or the arrow coming out from the left side indicates the liquid displaced from the pulp by the first washing liquid, and the arrow coming out from the right side indicates the liquid displaced by the second washing liquid. The washing filtrates may also be stored in the filtrate container mixed with each other, in which case the filtrate outflows have similar properties. In the shown preferred embodiments, the pulp is washed using two washing liquids. In the shown preferred embodiments, the filtrate discharged from the filtrate container is used as a washing liquid in one or two washers or it is removed from the process. It is also possible to divide the amount of the washing waters and the use of the filtrate waters in another manner suitable for the purpose.

In the shown figures, the arrows showing a washing liquid and entering a washer, but not coming out of a filtrate container, indicate a liquid outside the bleaching. This may be e.g. a condensate, raw water or 0 water of a dryer. The embodiments shown in FIGS. 1 to 2 may disclose a whole bleaching sequence, or the washing liquid entering the washer of the last stage may also be a filtrate from a washer of later bleaching stages, if one or more bleaching stage or stages were additionally added to the end of the presented bleaching sequence. Each of the FIGS. 3A to 3C shows the whole bleaching sequence used.

Figures IA to EI show a few preferred ways of arranging the washing water connection of the A D0N EOP bleaching sequence. According to the invention, the final pH of the D0N stage is neutral or alkaline. The washing waters entering the EOP washer may be a liquid outside the bleaching or a filtrate from the washers of the final bleaching. In FIG. 1A, the first filtrate fraction displaced from the pulp in the EOP washer by the first washing liquid is used as first washing water in a brown stock washer. The fraction displaced by the second washing liquid of the EOP washer is used in the washer of the DON stage. As first washing water in the washers of the DON and A stages, a liquid outside the bleaching is used. In these both washers, the first filtrate fraction displaced by the first washing water is conducted to an effluent treatment. The second filtrate fraction displaced by the second washing water of the DON stage washer is used as second washing water in the washer of 15 the preceding A stage. The second filtrate fraction displaced by the second washing liquid of the stage A washer is used as a second washing liquid for the preceding brown stock washer. The washing waters entering the DON washer may also be arranged in the reverse way (figure IB). In the arrangement according to figure IB, the first filtrate fraction displaced from the DON stage washer is used as second washing water for the brown stock washer, whereby all filtrate waters from the A stage washer are passed to the effluent treatment. Otherwise, the connections are analogous to those of FIG. 1A. When the pulp entering the DON stage washer is alkaline, the alkaline filtrate resulting from the EOP stage may be used as a first washing filtrate. Hence, in the case the second washing liquid is a liquid coming outside the bleaching, the pulp entering the EOP stage is even more pure than when the filtrate resulting from the EOP stage is used as second washing water. If the content of the residual peroxide is remarkably high at the end of the EOP stage, the arrangement of FIG. 1A enables a better utilisation thereof than the arrangement of FIG. 1B. The EOP stage may be an unpressurized or pressurized peroxide stage wherein oxygen may be used. The unpressurized EOP stage may also be carried out without oxygen so that in the present application, the abbreviation EOP refers also to the unpressurized EP stage.

In FIG. 1 C the first and the second washing water of the DON stage washer are arranged inversely to FIG. 1A. Thereby all filtrates from the DON stage washer are conducted into an effluent treatment, and the washing waters from the A stage are a liquid outside the bleaching. Otherwise, the connections are analogous to those of FIG. 1 A. The second filtrate fraction resulting from the A stage is used in the brown stock washer preferably not more than about 4 $m^3$/adtp. In the arrangement of FIG. 1C, the D0N stage and the subsequent EOP stage operate under more pure conditions enabling a reduced chemical consumption. Furthermore, the chlorine dioxide treatment of the D0N stage takes place undoubtedly under acid conditions also with a small chlorine dioxide charge. In the arrangement of figure ID, the first filtrate fraction displaced by the first washing water of the BOP washer is used as first washing water of the DON stage washer, and the second filtrate fraction displaced by the second washing water is used as second washing water in the D0N stage washer. This is possible without a risk of precipitation when the D0N pulp is alkaline at its entry into the washer. As first washing water of the brown stock washer a liquid outside the bleaching is used, and as second washing water the first filtrate fraction displaced by the first washing water of the D0N stage washer is used. The second washing filtrate fraction displaced by the second washing water of the D0N stage washer is used as the second washing water in the A stage washer. All filtrates from the A stage washer are conducted to the effluent treatment.

Because, in the case there are differences in the filtrate fractions, the more impure fraction, i.e. the first filtrate fraction resulting from the DON stage, is used as the last washing water in the washer prior to the bleaching or for dilution (preferably not more than about 4 $m^3$/adtp), i.e. it remains in the pulp, neither the organic matter dissolved in this cycle (FIG. 1D) during the bleaching nor the chemicals used will enter the washing cycle of brown stock and via it the recovery. The amount of the liquid coming outside the bleaching is smaller than in the earlier described cycles. The dissolved matter and the chemicals present in the filtrate resulting from the DON stage are discharged from the bleaching together with the filtrate from the A stage washer.

Figure 1D:
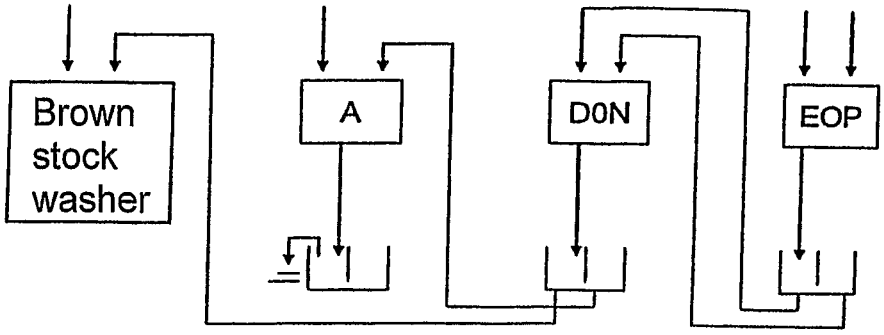
Figure 1E:
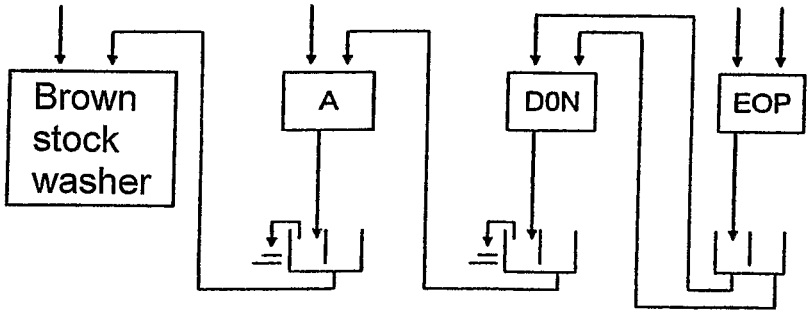

The arrangement of FIG. 1E is analogous to that of FIG. 1D, but the first filtrate fraction from the D0N stage washer is conducted to the effluent treatment, whereby the second filtrate fraction (preferably not more than about 4 $m^3$/adtp) displaced by the second washing water of the A stage washer is used as the second washing water for the brown stock washer. The amount of an acid required for the A stage is small. The entry of chlorides into the brown stock cycle is prevented more effectively, because filtrate is removed from the process both from the A stage washer and the D0N stage washer.

Figure 2A:
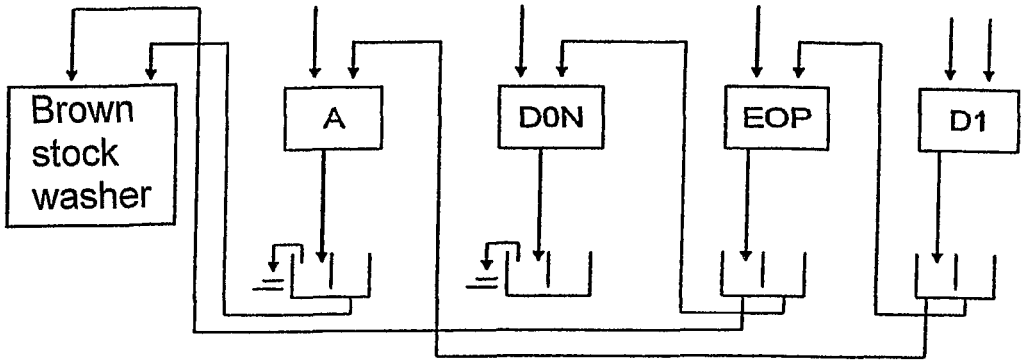
FIGS. 2A and 2B show a few preferred ways of arranging the filtrate and washing water connection of the A D0N EOP D1 bleaching according to the invention.
Figure 2B:
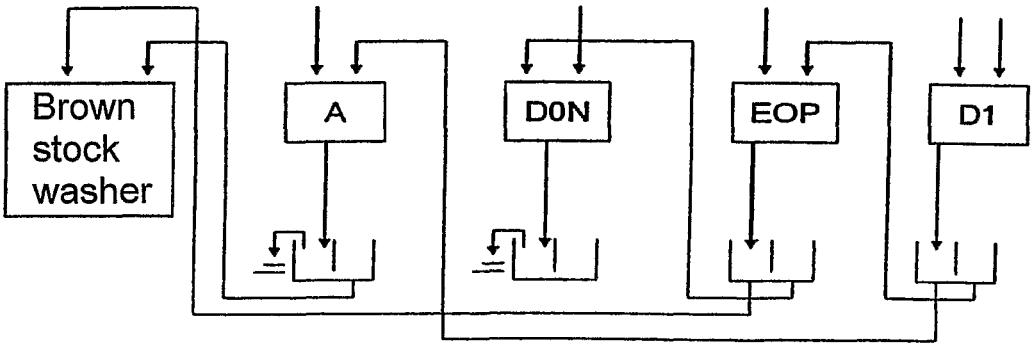
Figure 3A:
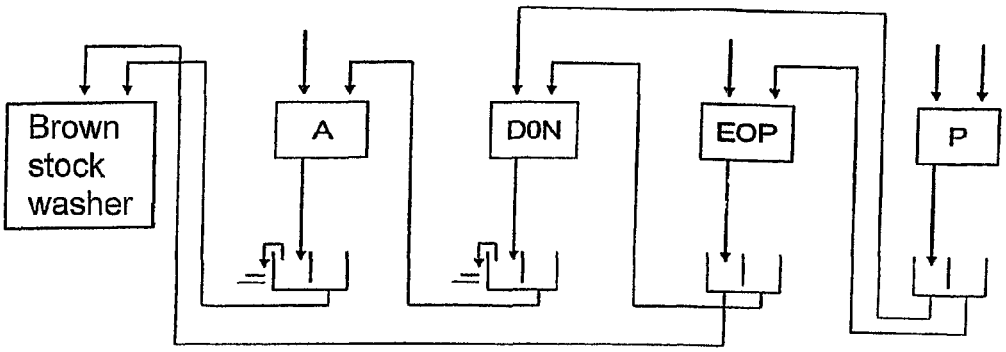
FIGS. 3A to 3C show a few preferred manners to arranging the A D0N EOP P bleaching according to the invention.
Figure 3B:
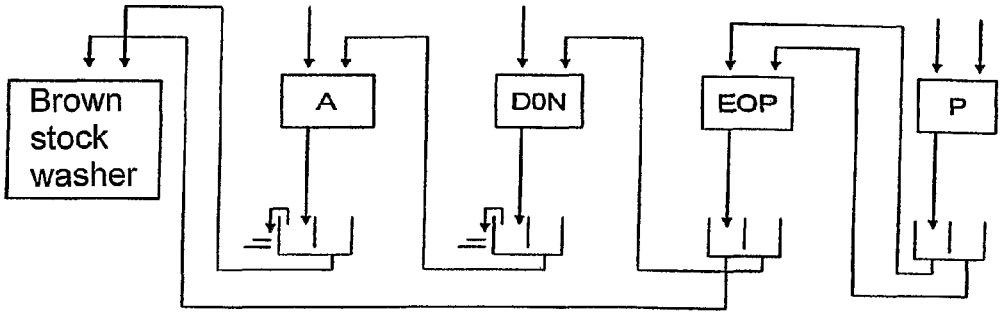
Figure 3C:
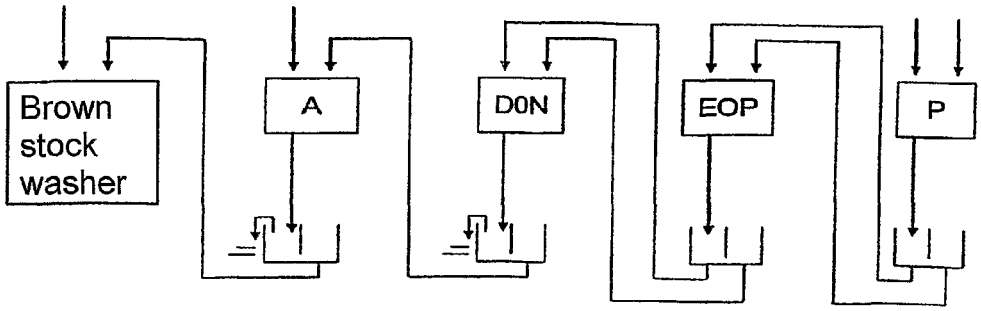

FIGS. 2A and 2B show some preferred ways of arranging the washing water connection of the A D0N EOP D1 bleaching. According to the invention, the final pH of the D0N stage is neutral or alkalic. The arrangement of the filtrate fractions is analogous to that of FIG. 1C up to the EOP washer including it. The washing waters fed into the D0N stage washer are arranged inversely to FIG. 1C. In the arrangement of FIG. 2A, the first washing filtrate from the D1 washer is used as the second washing water for the A stage, and the second washing filtrate from the D1 stage washer is used as second washing water for the EOP stage. The arrangement of FIG. 2B is analogous to that of FIG. 2A, except that the first and the second washing water entering the D0N stage washer are arranged inversely.

FIGS. 3A to 3C show some preferred ways of arranging the washing water connection of the bleaching sequence A D0N EOP P. According to the invention, the final pH of the D0N stage is neutral or alkalic. The P stage is either an alkaline peroxide stage or it comprises an acid chlorine dioxide treatment prior to the alkaline peroxide stage without an intermediate washing therebetween. Firstly, the washing water connections of the bleaching sequence A D0N EOP P may be arranged as shown in FIGS. 2A and 2B, wherein the P stage would be substituted for D1 stage. In the arrangement of FIG. 3A, the second filtrate fraction resulting from each of the washers and displaced by the second washing water is used as second washing water for the respectively preceding washer. The first filtrate fractions from the A and the D0N stage washers are passed to the effluent treatment. As first washing waters for the A and the D0N stage washers, a liquid outside the bleaching is used. As first washing water for the brown stock washer, the first washing filtrate from the EOP stage is used, while as the first washing water for the D0N stage washer, the first washing filtrate from the P stage is used. The arrangement of FIG. 3A could also be realized by inverting the arrangement of the washing waters entering the D0N stage washer.

Also in the arrangement of FIG. 3B, the second filtrate fraction resulting from each washer and displaced by the second washing water is used as the second washing water for the respectively preceding washer. As first washing waters for the A and DON stage washers a liquid outside the bleaching is used. The first filtrate fractions displaced by these are removed into the effluent treatment. The first filtrate fraction resulting from the P washer and displaced by the first washing water is used as first washing water for the BOP stage washer, and the first filtrate fraction resulting from the BOP stage washer and displaced by the first washing liquid is used as first washing water for the brown stock washer. The arrangement of FIG. 3C is as shown in FIG. 3B, but as first washing water of the DON stage washer, the first filtrate fraction resulting from the EOP stage washer is used, whereby as the first washing water for the brown stock washer, a liquid outside the bleaching is used. In the embodiments of FIGS. 3A to 3C, the stage DP could be substituted for the P stage.

REFERENCES

1. Crosby, H., TAPPI Monograph Series 27. 1963, p. 350.
2. Cook, R. A bleaching process for minimizing AOX discharges. Appita 44(1991)3, p. 179-183.
3. Ljungren, S., et al., Modified modern ClO2-bleaching. 1994 International Bleaching Conference, Jun. 13-16, 1994, Vancouver, British Columbia, p. 169-176.
4. Dence C. Reeve D. (editors), Pulp Bleaching, Principles And Practice, TAPPI, Atlanta 1996, p. 386.
5. Suess, H. U., Schmidt, K., Hopf, B.: Short sequence bleaching without penalties—options for Eucalyptus pulp. 59th Appita Conference, Auckland, New Zealand, 16-19 May 2005.
6. Gullichsen. J., Pilot plant application of the displacement bleaching process. Tappi J. 56(1973)11, p. 78-83.
7. Makkonen, H., Pitkänen, M., Làxen, T., oxygen bleaching as the critical link between chemical fiberization and fully bleached sulfite pulp. Tappi J 57(1974):2, p. 113-116.
8. Rapson, W., Anderson, C., Dynamic bleaching: Continuous movement of pulp through liquor increases bleaching rate. Tappi J. 49(1966):8, p. 329-334.
9. Gullichsen. J., Displacement bleaching—past, present future. Tappi J. 62(1979)12, p. 31-34.
10. Gullichsen, J., Fogelholm, C-J. (editors), Papermaking Science and Technology, Chemical pulping, 6A, 1999, p. 213.

The invention claimed is:

1. A process of bleaching chemical pulp, comprising an initial bleaching of the pulp sequentially comprising:

treating the pulp to reduce a content of transition metals in the pulp;

a first chlorine dioxide treatment (D0) and also including addition of alkali to the pulp after addition of chlorine dioxide;

a washing stage;

a following alkaline treatment with oxygen and hydrogen peroxide (EOP), wherein the initial bleaching comprises the sequence D0N EOP subsequent the treatment to reduce the content of transition metals, a pH of the pulp is adjusted to a value of from 10 to 12 prior to said washing stage by said addition of alkali, whereby organic matter in the pulp is dissolved and is removed from the pulp in said washing stage as a filtrate also containing a greater part of formed chlorides, the filtrate is prevented from entering the recovery system, while the content of chlorides in a filtrate from a washing stage subsequent to said EOP stage is reduced.

2. The process according to claim 1, wherein the treatment of the pulp to remove the transition metals comprises an acid treatment (A) of the pulp and a following wash prior to the D0N stage, whereby the initial bleaching sequence is A D0N EOP.

3. The process according to claim 1, wherein in the D0N stage alkali is added in the amount of from 1 to 20 kg as NaOH per ADMT.

4. The process according to claim 1, wherein in the D0N stage, the duration of the alkali treatment is from 5 sec to 60 min.

5. The process according to claim 1, wherein the alkali added to the pulp during the D0N stage is sodium hydroxide, white liquor, oxidized white liquor or a combination thereof.

6. The process according to claim 1, wherein in the D0N stage the pulp is treated, in addition to chlorine dioxide, also with ozone, per-acetic acid or Caro's acid or a combination thereof.

7. The process according to claim 1, wherein the filtrate waters of the D0N stage washer are led to a container prior to conducting them to an effluent treatment.

8. The process according to claim 7, wherein in said container the pH of the filtrate waters is adjusted to a value between above 10 and up to 12.

9. The process according to claim 2, wherein said acid (A) treatment is carried out at a temperature of from 60 to 100° C.

* * * * *

UNITED STATES PATENT AND TRADEMARK OFFICE

CERTIFICATE OF CORRECTION

PATENT NO. : 8,524,038 B2
APPLICATION NO. : 12/295378
DATED : September 3, 2013
INVENTOR(S) : Vilpponen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 631 days.

Signed and Sealed this
Fifteenth Day of September, 2015

Michelle K. Lee

Michelle K. Lee
*Director of the United States Patent and Trademark Office*